US006245500B1

(12) United States Patent
Nishi

(10) Patent No.: US 6,245,500 B1
(45) Date of Patent: Jun. 12, 2001

(54) METHOD FOR GELLING A PHOTOGRAPHIC COATING COMPOSITION AND AN APPARATUS OF THE SAME

(75) Inventor: Yasuo Nishi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/318,172

(22) Filed: May 25, 1999

(30) Foreign Application Priority Data

May 28, 1998 (JP) ..... 10-147559

(51) Int. Cl.[7] ..... G03C 1/047

(52) U.S. Cl. ..... 430/642; 430/935; 106/160.1; 530/355

(58) Field of Search ..... 430/642, 935; 106/160.1; 530/355

(56) References Cited

U.S. PATENT DOCUMENTS 3,396,027 * 8/1968 McFall et al. ..... 430/642
4,307,055 * 12/1981 Takeda et al. ..... 430/642
5,665,531 * 9/1997 Mutoh et al. ..... 430/569

* cited by examiner

*Primary Examiner*—Hoa Van Le
*Assistant Examiner*—Amanda C. Walke
(74) *Attorney, Agent, or Firm*—Jordan B. Bierman; Bierman, Muserlian and Lucas

(57) ABSTRACT

A method of cooling a photographic coating composition in a sol state is disclosed. The composition that includes photographic emulsion, an emulsified material or gelatin solution, or comprising combinations thereof is continuously cooled by employing heat exchanger, and after being transformed into a gel state, the resulting product is placed into a storage vessel.

23 Claims, 5 Drawing Sheets

METHOD FOR GELLING A PHOTOGRAPHIC COATING COMPOSITION AND AN APPARATUS OF THE SAME

FIELD OF THE INVENTION

The present invention relates to a method in which a photographic coating composition in a sol state, comprising a photographic emulsion, an emulsified material or gelatin solution, or comprising combinations thereof, is rapidly cooled to a temperature not more than the sol-gel transforming point, employing a transfer-type heat exchange system, and after being transformed into a gel state, the resulting product is placed into a storage vessel, and an apparatus of the same.

BACKGROUND OF THE INVENTION

Regarding techniques for gelling a photographic emulsion in a sol state, an emulsified material in a sol state, etc., methods have been employed in which, as described in Japanese Patent Publication Open to Public Inspection No. 8-95178, prior to being completely transformed into a gel state, those are placed into in a storage vessel, and, as described in Japanese Patent Publication No. 50-31447, Japanese Patent Publication Open to Public Inspection No. 60-104937, and Japanese Patent Publication Nos. 3-5210 and 3-68735, a material in a sol state is transformed to a gel state employing evacuation and heat transfer cooling.

The method is described further in Japanese Patent Publication No. 52-14717.

SUMMARY OF THE INVENTION

As described above, when placed in a storage vessel prior to being transformed into a gel state, the received material adheres to the vessel to adversely affect the handling during the re-melting process, as well as to a markedly lower heat efficiency during melting. Furthermore, in the method in which a material in a sol state is transformed into a gel state employing reduced pressure and heat transfer cooling, it has been difficult to constantly control the water content at a specific value, and it has been troublesome to readjust the silver amount through the addition of water after re-melting.

Furthermore, a coating compositions comprising a photographic emulsion in a sol state, an emulsified material, gelatin, etc. has been concentrated in order to enhance the rate of production without varying the coating and drying capacity. Such a coating composition is set (or gelled) employing vacuum setting, a heat transfer transmission system, etc. Thereafter, the coating composition comprising the photographic emulsion in a sol state, an emulsified material, gelatin, etc. was placed in a pot and stored in a refrigerator. When applied, the required amount of the composition is shredded employing a cutter, re-melted, and prepared in a tank. However, the cutting properties (shredding properties) are degraded due to changes in physical properties of a set composition (gelled composition) which has been concentrated, and at the same time, the adhesion to the vessel is increased. Thus, the productivity and product quality have been markedly deteriorated. In this connection, however, in order to achieve high speed coating, the concentration of the coating composition has been an inevitable condition.

Further, because during melting of the set composition (gelled composition), which has been concentrated, any amount of water results in a decrease, and therefore melting or preparing time has been prolonged, which adversely affect coating composition stability.

An object of the present invention is to solve problems described above, and to provide a method for gelling any composition comprising a photographic emulsion, an emulsified material, or gelatin solution, or comprising combinations thereof.

The method of the invention and embodiment thereof are described.

A method for gelling a photographic coating composition comprising steps of;

cooling continuously a photographic coating composition in a sol state containing a photographic emulsion, an emulsified material or gelatin solution, or containing combinations thereof into gel state, and receiving the photographic coating composition in a gel state in a storage vessel.

In the method mentioned above, the photographic coating composition is cooled while the photographic coating composition in a sol state flows.

In the method mentioned above, the photographic coating composition in a sol state is cooled to a temperature not more than the sol-gel transforming point while the photographic coating composition in a sol state flows.

In the method mentioned above, the photographic coating composition in a sol state is cooled by employing a transfer-type heat exchange system.

In the method mentioned above, the photographic coating composition in a sol state is cooled rapidly to a temperature not more than the sol-gel transforming point.

In the method mentioned above, the photographic coating composition in a sol state is cooled by a heat exchanger and the passing time of the composition through the heat exchanger and a tubing from the heat exchanger to a storage vessel is not shorter than that for the sol-gel transformation.

In the method mentioned above, sum of volume of the heat exchanger and a tubing from the heat exchanger to a storage vessel is determined so that the passing time of the composition through the heat exchanger and a tubing from the heat exchanger to the storage vessel is not shorter than that for sol-gel transformation.

In the method mentioned above, the photographic coating composition in a sol state is cooled at cooling zone provided between the heat exchanger and the storage vessel, and after gelling at least the surface, the composition is placed into the storage vessel.

In the method mentioned above, the photographic coating composition in a sol state is cooled so that the photographic coating composition is transformed into a gel state whereby the photographic coating composition becomes in noodle shape.

In the method mentioned above, the photographic coating composition in a gel state is received in the vessel in noodle shape.

In the method mentioned above, the photographic coating composition in a gel state is passed through a noodler which reduces the diameter of the cross section at right angles to the longitudinal direction of photographic coating composition in a gel state.

In the method mentioned above, the photographic coating composition is passed through tubing after cooling, and the photographic coating composition in a gel state is passed through a noodler thereafter.

In the method mentioned above, the maximum diameter of the cross section at right angles to the longitudinal direction of photographic coating composition in a gel state is between 1 and 10 mm.

In the method mentioned above, the above-mentioned gelled composition in noodle shape is cut into an appropriate size, and is placed into the storage vessel.

In the method mentioned above, the appropriate size has a ratio of volume/surface area of 0.02 to 0.3 cm.

In the method mentioned above, the photographic coating composition in a sol state is cooled under such condition that the photographic coating composition in a noodle state is cut into an appropriate size.

In the method mentioned above, the photographic coating composition in a sol state is cooled under such condition that the photographic coating composition in a noodle state is cut into an appropriate size.

In the method mentioned above, the photographic coating composition in a sol state is cooled under such condition that the photographic coating composition in a noodle state is cut into an appropriate size by weight of noodle by itself.

In the method mentioned above, the photographic coating composition in a sol state is cooled by employing a scraped surface heat exchanger.

In the method mentioned above, viscoelasticity of the photographic coating composition in a gel state just before passing the tubing is greater than that just before placing into the noodler.

Figure 1:
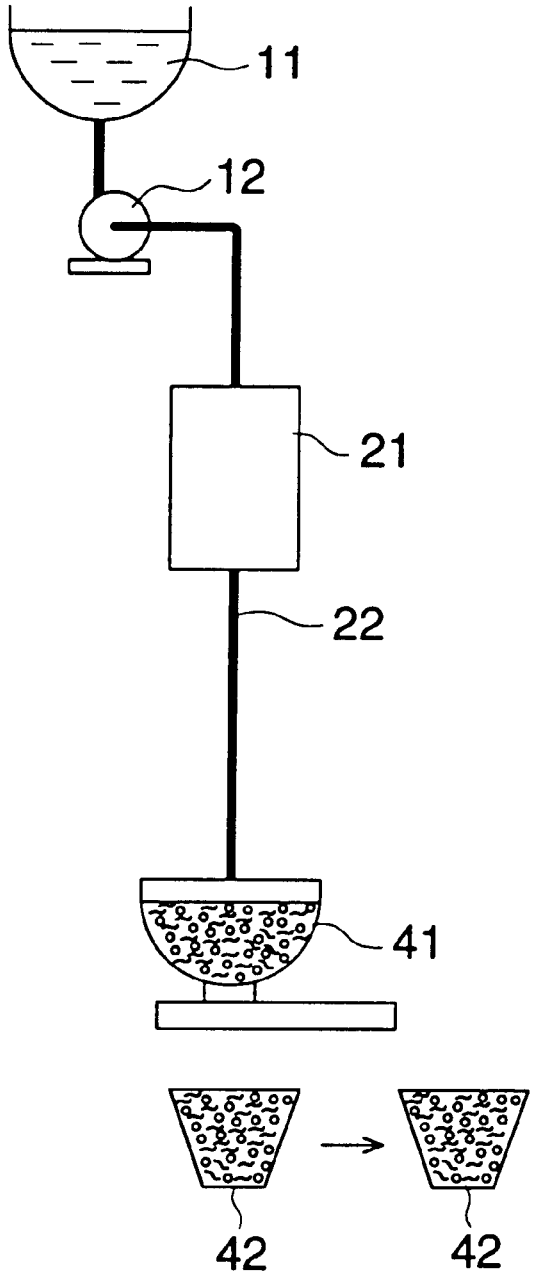
FIG. 1 is a schematic constitution view showing one example of the embodiment regarding the present invention.

EMBODIMENTS OF THE INVENTION (1) A method for gelling a photographic coating composition characterized in that a photographic coating composition in a sol state comprising a photographic emulsion, an emulsified material or gelatin solution, or comprising combinations thereof, is continuously and rapidly cooled to a temperature not more than the sol-gel transforming point, employing a transfer-type heat exchange system, and after having been transformed into a gel state, the resulting product is placed into a storage vessel.

(2) In a method in which a photographic coating composition in a sol state comprising a photographic emulsion, an emulsified material or gelatin solution, or comprising combinations thereof is continuously and rapidly cooled to a temperature not more than the sol-gel transforming point, employing a transfer-type heat exchange system, and after being transformed into a gel state, the resulting product is placed into a storage vessel, a method for gelling a photographic coating emulsion wherein the tubing volume from a transfer-type heat exchanger to a storage vessel is determined so that the passing time of the above-mentioned composition under transformation to a gel state is not shorter than that for the sol-gel transformation.

(3) In a method in which a photographic coating composition in a sol state comprising a photographic emulsion, an emulsified material or gelatin solution, or comprising the combination thereof is continuously and rapidly cooled to a temperature not more than the sol-gel transforming point, employing a transfer-type heat exchange system, and after being transformed into a gel state, the resulting product is placed into a storage vessel, a method for gelling a photographic coating composition wherein a chilling zone is arranged between a transfer-type heat exchanger and a storage vessel, and after gelling the surface, the composition is placed into the storage vessel.

(4) The method for gelling a photographic coating composition described in any one of items (1), (2), and (3), wherein after the transformation, the above-mentioned composition in a gel state is received in a storage vessel in noodle shape.

(5) The method for gelling a photographic coating composition described in item (4), wherein the distance across or the diameter of the cross section, which is at right angles to the longitudinal direction of the noodle-shaped composition in a gel state, is between 1 and 10 mm.

(6) The method for gelling a photographic coating composition described in items (4) or (5), wherein after the transformation, the above-mentioned gelled composition in noodle shape is cut into an appropriate size, and is placed into a storage vessel.

(7) The method for gelling a photographic coating composition described in item (6), wherein the above-mentioned appropriate size has a ratio of volume/surface area of 0.02 to 0.3 cm.

(8) The method for gelling a photographic coating composition described in any one of items (4) through (7), wherein after the transformation, the above-mentioned gelled composition is placed into a storage vessel, under cooled condition, so that the same can be cut into gelled noodles in an appropriate size.

(9) A method for gelling a photographic coating composition characterized in that a scraped surface heat exchanger is provided, which continuously and rapidly cools the photographic coating composition in a sol state comprising a photographic emulsion, an emulsified material or gelatin solution, or comprising combinations thereof to a temperature not more than the sol-gel transforming point, while maintaining the sol state, and the tubing volume requiring a passing time greater than that for the sol-gel transformation, is structured to be between the above-mentioned scraped surface heat exchanger and the storage vessel.

(10) A method for gelling a photographic coating composition wherein a scraped surface heat exchanger is provided, which continuously and rapidly cools the photographic coating composition in a sol state comprising a photographic emulsion, an emulsified material or gelatin solution, or comprising combinations thereof to a temperature not more than the sol-gel transforming point, while maintaining the sol state; the tubing volume requiring a passing time greater than that for the sol-gel transformation is structured to be between the above-mentioned scraped surface heat exchanger and the storage vessel, and further, a noodle-making device is provided at the outlet of the above-mentioned tubing for extruding into the above-mentioned storage vessel.

(11) A method for gelling a photographic coating composition characterized in that a scraped surface heat exchanger is provided, which continuously and rapidly cools the photographic coating composition in a sol state comprising a photographic emulsion, an emulsified material or gelatin solution, or comprising combinations thereof to a temperature not more than the sol-gel transforming point, while maintaining the sol state; a tubing volume requiring a passing time greater than that for the sol-gel transformation is arranged between the above-mentioned scraped surface heat exchanger and the storage vessel; further, a noodle-making device is provided at the outlet of the above-mentioned tubing for extruding into the above-mentioned storage vessel, and a cutting device is provided which cuts the above-mentioned noodle-shaped composition into an appropriate size.

(12) The method for gelling a photographic coating composition described in items (9), (10), or (12) characterized in that a cooling device is provided between the tubing for injection and the storage vessel.

(13) In the method for gelling a photographic coating composition described in any one of items (2) through (8), in which a photographic coating composition in a sol state comprising a photographic emulsion, an emulsified material or gelatin solution, or comprising combinations thereof is continuously and rapidly cooled to a temperature not more than the sol-gel transforming point employing a transfer-type heat exchange system, and after being transformed into a gel state, the resulting product is placed into a storage vessel, a method for gelling a photographic coating composition wherein a liquid which results in no adverse photographic effects is employed as a leading or pushing liquid in the heat exchange section of the above-mentioned heat exchange system.

(14) In t he method for gelling a photographic coating composition described in any one of items (2) through (8), in which a photographic coating composition in a sol state comprising a photographic emulsion, an emulsified material or gelatin solution, or comprising combinations thereof is continuously and rapidly cooled to a temperature not more than the sol-gel transforming point employing a transfer-type heat exchange system, and after being transformed into a gel state, the resulting product is placed into a storage vessel, a method for gelling a photographic coating composition wherein a liquid which results in no adverse photographic effects is employed as a leading or pushing liquid in the heat exchange section of the above-mentioned heat exchange system; the interface between the above-mentioned replaced liquid in a gel state and a leader liquid or a pushing liquid is detected employing a sensor, and the above-mentioned replaced liquid and leader or pushing liquid are segregated.

Time for sol-gel transformation is that the composition in sol state requires to change to gel state.

The composition in sol state is cooled while it flows, that is, the composition in sol state is cooled when it is conveyed, for example, in a tube.

Sol-gel transformation temperature is temperature at that at least a part of the composition in sol state start gelling.

The composition is cooled rapidly, for example, within 30 minutes, preferably 15 minutes to sol-gel transformation temperature.

When the surface of the composition does not show stickiness, at least the surface is in gel state.

DETAILED DESCRIPTION OF THE INVENTION

The present invention can be applied to a photographic coating composition comprising all types of photographic emulsions, emulsified materials, and gelatin, and combinations thereof. Some examples in which the present invention is specifically employed are described below.

As examples of representative emulsion formulas to which the present invention is specific, are the following three types.

Emulsion Example 1: this emulsion comprises hexagonal tabular silver iodobromide grains which are employed for orthochromatic direct exposure, etc.; grains having an average grain diameter of 0.82 μm, an average thickness of 0.18 μm, an average aspect ratio of 4.5, a grain diameter distribution of 18.1 percent, a distance between twinned crystal surfaces of 0.020 μm, a ratio of the distance between twined crystal surfaces to the thickness of at least 5, occupies 97 percent (in the number of grains) of all the tabular grains, and silver iodobromide having Ag of 10.5 mole percent is formed.

Emulsion Example 2: this emulsion comprises internal high iodine-type monodisperse spherical silver iodobromide grains employed for regular direct exposure, and tetradecahederal monodisperse core-shell type silver iodobromide grains are formed, which have an average grain diameter of 0.45 μm, a grain diameter distribution of 15 percent, and an average Ag of 12.3 mole percent.

Emulsion Example 3: this emulsion comprises grains having a small diameter employed for a laser imager, and tetradecahederal monodisperse spherical silver iodobromide grains are formed, which have an average grain diameter of 0.20 μm, and an average Ag of 10.2 mole percent.

Further, as other examples of emulsion formulas to which the present invention is applied, there are three types in which cubic silver chlorobromide grains are formed which have compositions and average grain diameters as described below.

Emulsion Example 4: orthochromatic

AgClBr (AgCl 99.5%) 0.40 μm cubic+AgClBr (AgCl 99.5%) 0.50 μm cubic

Emulsion Example 5: regular

AgClBr (AgCl 99.5%) 0.64 μm cubic+AgClBr (AgCl 99.5%) 0.71 μm cubic

Emulsion Example 6: panchromatic

AgClBr (AgCl 99.5%) 0.38 μm cubic+AgClBr (AgCl 99.5%) 0.40 μm cubic

Further, other than photosensitive silver halide emulsions, the present invention can be applied to the following dispersions.

In the field of silver halide light-sensitive color photographic materials, the method of the present invention is applied to dispersions such as oil-in-water type dispersions prepared by dispersing, into a gelatin medium, a compound which compliments the oxide of a color developing agent represented by hydroquinone derivatives. Specific compounds are disclosed in Japanese Patent Publication Open to Public Inspection Nos. 9-204024, 9-203995, 9-197636, 9-17260, 8-129243, 4-344641, etc.

In the field of silver halide light-sensitive color photographic materials, the method of the present invention can be applied to oil-in-water type dispersions in ultraviolet ray absorbing agents in a gelatin medium. Specific compounds are disclosed in Japanese Patent Publication Open to Public Inspection Nos. 9-197611, 9-171239, 8-69087, etc.

In the field of silver halide light-sensitive color photographic materials, the method of the present invention can be applied to oil-in-water type dispersion of colored couplers in a gelatin medium. Specific compounds of yellow couplers are disclosed in Japanese Patent Publication Open to Public Inspection No. 5-281675; those of magenta couplers are disclosed in Japanese Patent Publication Open to Public Inspection Nos. 9-197634, 9-179258, 9-146235, 7-128822, and 7-92630, and those of cyan couplers are disclosed in Japanese Patent Publication Open to Public Inspection Nos. 9-197638, 9-179257, 9-179258, 9-146235, 6-186688, etc.

Further, specific examples of fine particle-in-water dispersions prepared by dispersing a solid coupler are disclosed in Japanese Patent Publication Open to Public Inspection Nos. 5-11379, and 4-344641.

In the field of silver halide light-sensitive color photographic materials, the method of the present invention can be applied to oil-in-water type dispersions prepared by employing colloidal silver, non-photosensitive fine silver halide grains, matting agents, solid dye dispersions, slipping agents, etc.

Specific examples of colloidal silver are disclosed in Japanese Patent Publication Open to Public Inspection Nos. 9-22087, 7-270974, etc. Examples of non-photosensitive fine silver halide grains are disclosed in Japanese Patent Publication Open to Public Inspection Nos. 7-219108, 3-200245, 3-209236, etc.

Specific examples of matting agents are disclosed in Japanese Patent Publication Open to Public Inspection No. 9-5918, etc.

Specific examples of solid dye dispersions are disclosed in Japanese Patent Publication Open to Public Inspection Nos. 7-319121, 4-121735, etc.

Further, specifications of silver grains for an image setter, to which the present invention is applicable, are as follows.

| For Image Setter | |
|---|---|
| Size of silver particle | 0.20 micron |
| Shape | hexagonal sphere |
| Composition | AgCl/Br = 70/30 |
| Crystal habit | regular crystal |

Furthermore, those described in silver halide emulsion A and emulsion C in Example 1 of Japanese Patent Publication Open to Public Inspection No. 9-281645 are as follows.

| For Room-light Contact | |
|---|---|
| Size of silver particle | 0.12 micron |
| Shape | hexagonal sphere |
| Composition | AgCl/Br = 98/2 |
| Crystal habit | regular crystal |

Further, there are those described in silver halide emulsion E1 in Example 1 of Japanese Patent Publication Open to Public Inspection No. 7-104412. It has been confirmed that the gelling method of the present invention can be applied to all types of these emulsions.

The embodiments of the present invention are explained with reference to the attached drawings.

FIG. 1 is a schematic constitution view showing one example of the present invention. A second-ripened photographic emulsion, an emulsified material and a gelatin solution are placed into stock kettle 11. The resulting product is conveyed to heat exchanger 21 of heat transfer-type heat exchange system employing pump 12; is rapidly cooled to no more than the sol-gel transforming temperature; is gelled in tubing 22; and is placed into storage vessel 41. The composition into the storage vessel 41 is weighed and divided, and is fed into a plurality of pots 42. The composition placed into the pots are refrigerated and stored for the subsequent process. Sol-gel transforming temperature is temperature at that at least a part of the composition in sol state start gelling.

Further, the above-mentioned tubing 22 is constituted in such a way that the tubing volume is determined so that a passing time of the composition which is under transformation to a gel state is not shorter than that of the sol-gel transforming time. In such a manner, a time lag during gelling is compensated for to result in perfect gelling. Thus, adhesion to a storage vessel is minimized and no re-adhesion between gelled compositions occurs and re-melting is readily carried out.

Figure 4:
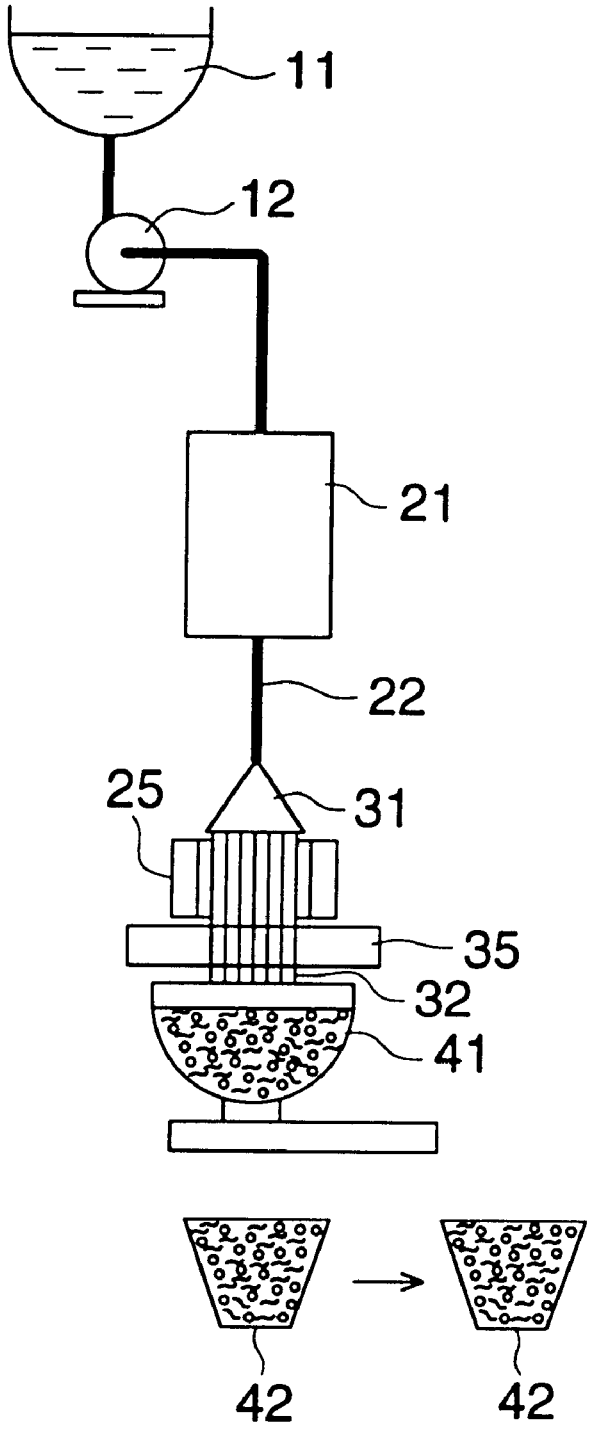
FIG. 4 is a schematic constitution view showing still another example of the embodiment regarding the present invention.

Further, one of the preferable embodiment, cooling zone 25 is provided between the above-mentioned heat transfer-type heat exchange system heat exchanger 21 and the storage vessel 41, as shown in FIG. 4. By employing this method, adhesion to a storage vessel is minimized and no re-adhesion between gelled compositions occurs and re-melting is readily carried out.

The gelled composition is transformed to noodles 32 employing an extruder such as noodler 31, and is received in the vessel. By transforming to noodle shape the composition can be handled easily when it is melt again easily after refrigerate. Melting time is reduced markedly since the surface area per volume becomes greater, and cutting operation of the composition in gel state can be made simple. The transporting the composition becomes easy when the composition in gel state extruded in noodle shape is received by a storage vessel 41.

Figure 5:
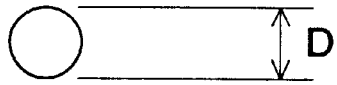
FIG. 5 is a graph showing the relationship between the size of a set composition (a gelled composition) and the rate of melting.
Figure 5:
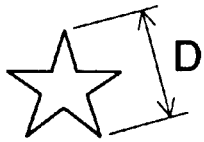
Figure 5:
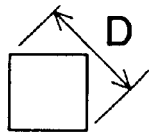
Figure 5:
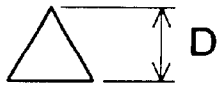

As shown in cross sectional views of FIG. 5, the maximum distance across D of the cross section, which is at right angles to the longitudinal direction, is between 1 and 10 mm, and is more preferably from at least 1 mm to less than 5 mm. and especially preferably from at least 1 mm to less than 3 mm. This shortens the melting time during re-melting, reduces the preparation cost of the extruder and reduces the forming fog in case that the composition is a light sensitive material. Further, listed as the cross sectional shapes are a circle, a star, a triangle, a square, etc. as shown in FIGS. 5(*a*), 5(*b*), 5(*c*), and 5(*d*).

Figure 3:
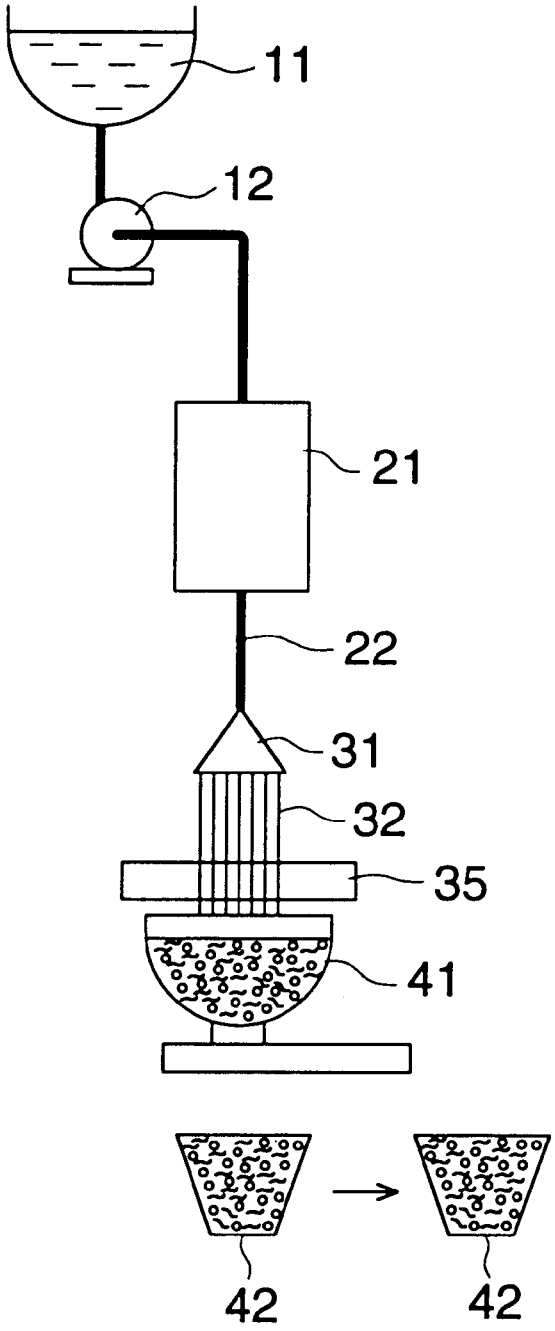
FIG. 3 is a schematic constitution view showing another example of the embodiment regarding the present invention.

Further, after the gelled composition is converted to noodles 32 employing the noodle-making device 32, as shown in the schematic constitution view of FIG. 3, above-mentioned noodles 32 as they are in a gel state, are cut into an appropriate length. The appropriate size is to have is ratio of volume/surface area of 0.02 to 0.3 cm. Herein, the ratio of the volume/surface area is preferably between 0.02 and 0.13 cm, and is more preferably no less than 0.02 to less than 0.03 cm. In such a manner, the melting time during re-melting is further shortened.

In this embodiment the viscoelasticity of the composition, i.e., just before passing the tubing, is not shorter than that just before the noodler, and therefore the cut pieces of composition after cutting or stored in a storage vessel are prohibited to stick each other or to adhere to the vessel. Further the re-melting time can be shortened.

Figure 6:
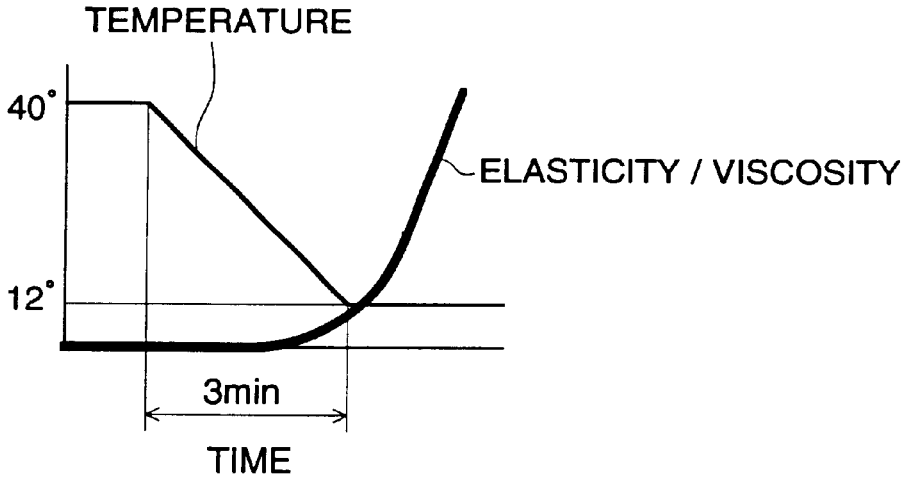
FIG. 6 shows various cross-sectional views which are at right angles to the longitudinal direction, and cross-sectional views showing maximum cross distance D.

An example of method for measuring viscoelasticity is described below. An instrument named Rheolograph Sol, product of Toyoseikiseisakusho Co., Ltd., is employed. Composition is injected into a measuring cell and cooling pattern same as the cooling condition of cooling means (SSHE) is programmed with the instrument. For example, setting the cooling time necessary from 40 to 12° C. to be 3 minutes, i.e., flow is 7 litter per minutes for volume of the SSHE of 21 liter, data of viscoeleasticity, temperature (ordinate) and time (abscissa) are obtained as illustrated in FIG. 6. In this case, viscoelasticity just after cooling is that of measured at 3 minutes, and the values of viscoelasticity measured at the outlet portion of the SSHE are those measured at 4 minutes (level 2), 5 minutes (level 3) and 6.3 minutes (level 3). In each level the viscoelasticity becomes greater at the side of outlet of SSHE after the residence than that of measured just before cooling. This shows that the gelation progresses during the residence. This demonstrates also that level 4 having residence time of 3.3 minutes shows the highest viscoelasticity and gel status is preferable.

Cutting to the above-mentioned appropriate length can be carried out without employing a cutter. For example, by regulating the cooling conditions from sol state to gel state appropriately the ratio (volume/surface area) of the gelled composition is controlled preferably. The gelled composition can be cut by weight of noodle by itself according to the cooling conditions. The cooling temperature is preferably not more than 15 kC. In such a manner, appropriately cut gelled composition is placed into the storage vessel 41. By so doing, the gelling method is further simplified and the cost of equipment employed for this method is reduced.

A cooling zone 25 may be formed by installing a cooling device between an ejection tubing 22 and the storage vessel 41, as shown in the schematic constitution view of FIG. 4. In a later step of extruder 31 the cooling zone is provided and therefore, in case that a part of the composition is not transformed to gel state it is cooled in this zone before placed in the vessel.

Further, in any embodiments of claim 2 through 8, easy handling is achieved by employing a top leading liquid and a pushing liquid.

Further the interface between the transformed composition to a gel state and the leader liquid or the pushing liquid is detected employing a sensor, and the above-mentioned transformed liquid and the leader liquid or the pushing liquid are separated so that the above-mentioned transformed composition in a gel state is smoothly placed into the storage vessel.

As the leader liquid and pushing liquid, for example, deionized water or aqueous gelatin solution is employed. The liquid has no adverse effect on photographic properties when they mixed in small amount with the coating composition. By employing the leader liquid, gelling temperature at the leading edge area of the transformed composition to a gel state is accurately maintained, and gelling is perfectly carried out until the end. By employing the pushing liquid, the transformed composition at the end area can be extruded from the heat exchanger 21 without any loss.

Still further, by detecting the interface area between the leader liquid or the pushing liquid and the transformed composition to a gel state, admixture to the storage vessel 41 or the pots 42 is prevented.

An example of the heat transfer-type heat exchanger 21 employed as the rapid cooling means is a scraping-type heat exchanger (SSHE). This is optimum in the present invention. Besides SSHE a static mixer-including double tube and multi-tube-type static mixer-including double tube may be employed.

A scraped surface heat exchanger basically consists of a vertical or horizontal jacketed cylinder fitted with a rotating shaft on which scraper blades are mounted. Product is pumped through the cylinder while cooling media is circulated in the annular space between the cylinder and the jacket. Product is constantly being scraped off this wall by the blades, allowing new product to be exposed to thermal treatment.

EXAMPLES

Example 1

Pot adhesion loss and ease of removal were tested, and the following results were obtained.

In conventional systems, after 20 kg of a 5% or 10% of aqueous gelatin solution were loaded into a plastic pot, it was allowed to set (transform to a gel state) and the set material was stored in a refrigerator for a day. After that, it was divided into eight parts employing a cutting device and put into a pot while turning the above-mentioned pot upside down. The ratio of the residue adhered to the pot was then measured.

Figure 2:
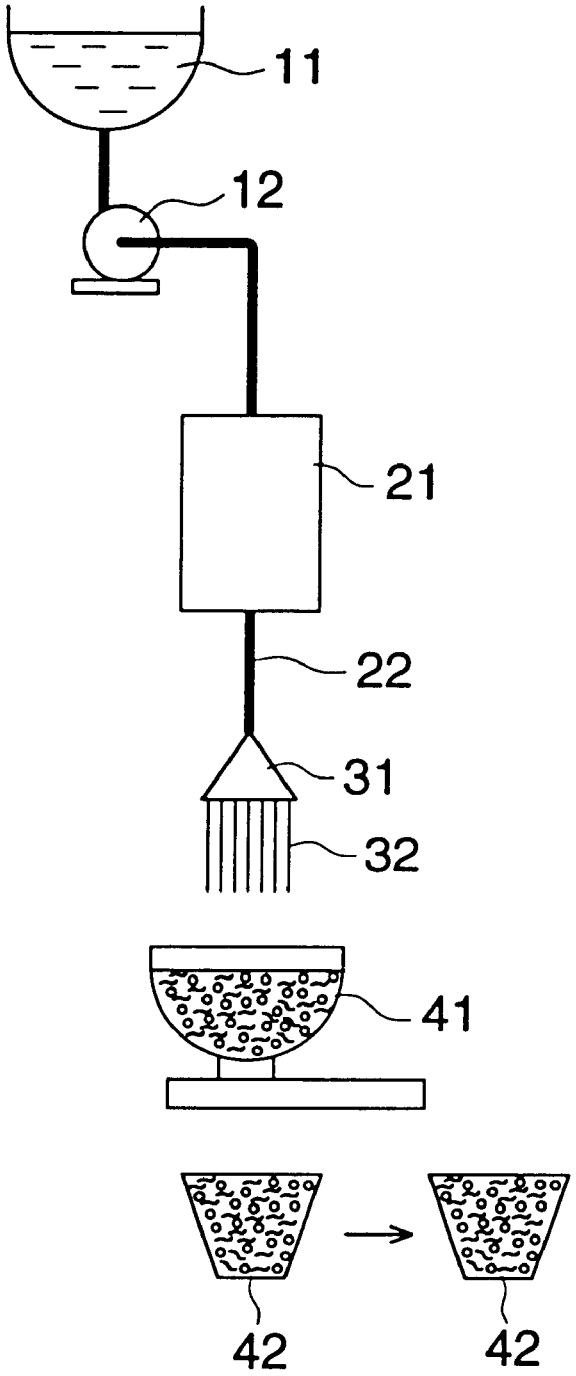
FIG. 2 is another schematic constitution view showing one example of the embodiment regarding the present invention.

On the other hand, employing the new-type method and apparatus illustrated in FIG. 2 according to the present invention in which continuous gelling is carried out. Each of an aqueous gelatin solution in an amount of 20 kg having concentration of 10% and 5% respectively were allowed to cool by a scraped surface heat exchanger (SSHE), set into a noodle shape having an outer diameter of 6 mm and cut to have a length of 100 mm by a cutter, put into a 20 l pot continuously, and refrigerated for one day at 5° C. The surface condition of the noodle before and after storage were measured.

Sol-gel transformation time for samples were varied by changing the length of tubing at outlet side of SSHE to obtain desirable state of gelled noodle.

Pump 2 is a plunger pump made by Sakura manufacturing Co, SSHE 21 is a product of APV, employing ammonia as coolant, providing pressure proof tubing at outlet side having inner diameter of 64 mm made of SUS, and noodler 31 is that having noodle diameter of 5 mm.

The results are summarized in Table 1. In the Table 1, the standard is;

Before storage
- A: Not stuck to finger.
- C: Stuck to finger.

After storage
- A: Raveled easily with hand.
- C: Not raveled easily.

TABLE 1

| Sample | Conc. of gelatin solution % | Temp. of gelatin solution ° C. | Flow volume (l/m) | Composition temperature at outlet of SSHE | Temp. of coolant | Tubing volume at outlet of SSHE (1) | Staying time at outlet of SSHE (min) | Gellation state of noodle before storage | Noodle state after storage |
|---|---|---|---|---|---|---|---|---|---|
| 1 | 10 | 40 | 7 | — | — | — | — | — | — |
| 2 | 10 | 40 | 7 | 12 | 3 | 7 | 1 | C | C |
| 3 | 10 | 40 | 7 | 12 | 3 | 14 | 2 | B | C |
| 4 | 10 | 40 | 7 | 12 | 3 | 23 | 3.3 | A | A |
| 5 | 5 | 40 | 7 | 12 | −8 | 7 | 2 | C | C |
| 6 | 5 | 40 | 7 | 12 | −8 | 23 | 3.3 | B–C | C |
| 7 | 5 | 40 | 7 | 12 | −8 | 34 | 4.8 | A | A |

As for Samples 1 and 4, noodles were put into another vessel (by turning the pot upside down) and the ratio of residue adhered to the pot was measured.

TABLE 2

| Sample | Residual Ratio in Pot (Residue/Total) × 100 |
|---|---|
| 1 | 1% |
| 4 | 0.1% |

As described above, the method of the present invention and the apparatus thereof, as compared to the conventional method, resulted in a marked decrease in adhesion to a pot, provided more ease in handling, and exhibited excellent quality as well as high productivity due to operation maintained as weighed.

Up-to-date, each composition in a definite amount has been stored in a refrigerator, and the required amount has been shredded. The shredded composition has been re-melted in a kettle and subsequently prepared. However, due to variations in physical properties of the set composition (gelled composition) which had been concentrated, cutting properties (shredding properties) have been deteriorated. Along with deterioration, the adhesion to the vessel increased, and re-melting was accompanied only with great difficulty and the productivity and the product quality were markedly degraded, the melting time was prolonged, and the productivity and the composition stability were adversely affected. However, with the use of the method of the present invention and the apparatus thereof for gelling a photographic coating composition comprising a photographic emulsion, an emulsified material, or gelatin solution, or comprising combinations thereof, the shredding step of a gelled composition required at re-melting is completely removed and it has become possible to markedly improve productivity and product quality by converting the set composition into small shapes.

What is claimed is:

1. A method for gelling a photographic coating composition comprising steps of;

cooling continuously, by a transfer heat exchange system, a photographic coating composition in a sol state to a temperature not more than the sol-gel transforming point while the photographic coating composition flows, said coating composition containing a photographic emulsion, an emulsified material or gelatin solution, or containing combinations thereof into gel state, and receiving the photographic coating composition in a gel state in a storage vessel.

2. A method of claim 1, wherein the photographic coating composition is cooled while the photographic coating composition in a sol state flows.

3. A method of claim 1, wherein the photographic coating composition in a sol state is cooled rapidly to a temperature not more than the sol-gel transforming point.

4. A method of claim 1, wherein the photographic coating composition in a sol state is cooled by a heat exchanger and the passing time of the composition through the heat exchanger and a tubing from the heat exchanger to a storage vessel is not shorter than that for the sol-gel transformation.

5. A method of claim 4, wherein sum of volume of the heat exchanger and a tubing from the heat exchanger to a storage vessel is determined so that the passing time of the composition through the heat exchanger and a tubing from the heat exchanger to the storage vessel is not shorter than that for sol-gel transformation.

6. A method of claim 1, wherein the photographic coating composition in a sol state is cooled at cooling zone provided between the heat exchanger and the storage vessel, and after gelling at least the surface, the composition is placed into the storage vessel.

7. The method of claim 1, wherein the photographic coating composition in a sol state is cooled so that the photographic coating composition is transformed into a gel state whereby the photographic coating composition becomes in noodle shape.

8. The method of claim 7, wherein the photographic coating composition in a gel state is received in the vessel in noodle shape.

9. The method of claim 7, wherein the photographic coating composition in a gel state is passed through a noodler which reduces the diameter of the cross section at right angles to the longitudinal direction of photographic coating composition in a gel state.

10. The method of claim 8, wherein the photographic coating composition is passed through tubing after cooling, and the photographic coating composition in a gel state is passed through a noodler thereafter.

11. The method of claim 1, wherein the maximum diameter of the cross section at right angles to the longitudinal direction of photographic coating composition in a gel state is between 1 and 10 mm.

12. The method of claim 7, wherein the maximum diameter of the cross section at right angles to the longitudinal direction of photographic coating composition in a gel state is between 1 and 10 mm.

13. The method of claim 1, wherein the above-mentioned gelled composition in noodle shape is cut into an appropriate size, and is placed into the storage vessel.

14. The method of claim 7, wherein the above-mentioned gelled composition in noodle shape is cut into an appropriate size, and is placed into the storage vessel.

15. A method of claim 12, wherein the appropriate size has a ratio of volume/surface area of 0.02 to 0.3 cm.

16. A method of claim 7, wherein the photographic coating composition in a sol state is cooled under such condition that the photographic coating composition in a noodle state is cut into an appropriate size.

17. A method of claim 9, wherein the photographic coating composition in a sol state is cooled under such condition that the photographic coating composition in a noodle state is cut into an appropriate size.

18. A method of claim 17, wherein the photographic coating composition in a sol state is cooled under such condition that the photographic coating composition in a noodle state is cut into an appropriate size by weight of noodle by itself.

19. A method of claim 1, wherein the photographic coating composition in a sol state is cooled by employing a scraped surface heat exchanger.

20. A method of claim 4, wherein the photographic coating composition in a sol state is cooled by employing a scraped surface heat exchanger.

21. A method of claim 6, wherein the photographic coating composition in a sol state is cooled by employing a scraped surface heat exchanger.

22. A method of claim 7, wherein the photographic coating composition in a sol state is cooled by employing a scraped surface heat exchanger.

23. A method of claim 10, wherein viscoelasticity of the photographic coating composition just before passing the tubing is greater than that just before placing into the noodler.

* * * * *